US008180602B2

(12) United States Patent
Barboza et al.

(10) Patent No.: US 8,180,602 B2
(45) Date of Patent: May 15, 2012

(54) METHOD FOR MECHANICAL AND CAPILLARY SEAL ANALYSIS OF A HYDROCARBON TRAP

(75) Inventors: Scott A Barboza, Houston, TX (US); John Steven Davis, Kingwood, TX (US); William R James, Austin, TX (US); Jean Christophe Sempere, Houston, TX (US); Xiaoli Liu, State College, PA (US)

(73) Assignee: ExxonMobil Upstream Research Company, Houston, TX (US)

( * ) Notice: Subject to any disclaimer, the term of this patent is extended or adjusted under 35 U.S.C. 154(b) by 936 days.

(21) Appl. No.: 12/083,020

(22) PCT Filed: Sep. 12, 2006

(86) PCT No.: PCT/US2006/035416

§ 371 (c)(1),
(2), (4) Date: Aug. 13, 2008

(87) PCT Pub. No.: WO2007/055794

PCT Pub. Date: May 18, 2007

(65) Prior Publication Data

US 2009/0125238 A1 May 14, 2009

Related U.S. Application Data

(60) Provisional application No. 60/731,095, filed on Oct. 28, 2005.

(51) Int. Cl.
*G06F 17/10* (2006.01)

(52) U.S. Cl. ..... 703/2; 703/9

(58) Field of Classification Search ..... 703/2, 9
See application file for complete search history.

(56) References Cited

U.S. PATENT DOCUMENTS

| | | | |
|---|---|---|---|
| 5,482,116 | A | 1/1996 | El Rabaa et al. |
| 6,484,102 | B1 | 11/2002 | Holmes |
| 6,826,486 | B1 | 11/2004 | Malinverno |
| 6,941,804 | B2 | 9/2005 | Hasem et al. |
| 2005/0182566 | A1 | 8/2005 | DiFoggio |
| 2005/0197780 | A1 * | 9/2005 | Moos et al. ..... 702/14 |

OTHER PUBLICATIONS

G.M. Ingram et al., "Sealing processes and top seal assessment," 1997, Elsevier, pp. 165-174.*

(Continued)

*Primary Examiner* — Paul Rodriguez
*Assistant Examiner* — Russ Guill
(74) *Attorney, Agent, or Firm* — ExxonMobil Upstream Research Company, Law Dept.

(57) ABSTRACT

Method for making a probabilistic determination of total seal capacity for a hydrocarbon trap, simultaneously considering both capillary entry pressure and mechanical seal capacity, and where capillary entry pressure is estimated by relating it directly to the buoyancy pressure applied by the hydrocarbon column to the top seal. The method thus considers the substantial uncertainty associated with input parameters, which uncertainty limits the utility of such analyses for robust hydrocarbon column height and fluid contact predictions. The method disclosed for estimating seal capillary entry pressure, the requisite input parameter for capillary seal capacity analysis, by inverting trap parameters avoids the need for direct measurement by mercury injection capillary capacity tests on small pieces of rock, which test results often are not available for all desired locations nor are they necessarily representative of adjacent rocks in the seal.

13 Claims, 7 Drawing Sheets

OTHER PUBLICATIONS

Helen Lewis et al., "Geomechanical simulations of top seal integrity," 2002, Elsevier, pp. 75-87.*

Michael Holmes, "Capillary pressure & relative permeability petrophysical reservoir models," 2002, Digital Formation Inc., pp. 1-22.*

Simmons, E.L., et al., "Predicting Deepwater Fracture Pressures: A Proposal," paper SPE 18025, (1988) SPE Annual Technical Conference and Exhibition, Houston, Oct. 2-5.

Rocha, L.A., et al., "A New Simple Method to Estimate Fracture Pressure Gradient," *Pore Pressure and Fracture Gradients* [Serieal] SPE Reprint Series, (1999) pp. 101-107.

Berg, R.R., "Capillary Pressures in Stratigraphic Traps," AAPG Bulletin 59, (1975) pp. 939-956.

Schowalter, Tim, "Mechanics of Secondary Hydrocarbon Migration and Entrapment," AAPG Bulletin 63, (1979), pp. 723-760.

Smith, D., "Theoretical Considerations of Sealing and Non-Sealing Faults," AAPG Bulletin 50, (1996) pp. 363-374.

Sales, John, "Seal Strength vs. Trap Closure—A Fundamental Control on the Distribution of Oil and Gas,"*Seals, Traps, and the Petroleum System*, R.C. Surdam, ed., AAPG Memoir 67, (1977), pp. 57-83.

McCain, W.D., "Resevoir-Fluid Property Correlations—State of the Art," *SPE: Resevoir Engineering* 6, (1991), pp. 266-272.

Firoozabadi, A., "Surface Tension of Water-Hydrocarbon Systems at Reservoir Conditions," paper No. 87-38-30, presented at the 38$^{th}$ Annual Technical Meeting of the Petroleum Society of CIM, Calgary, (1987) pp. 533-554.

Mandl, G., "Hydrocarbon Migration by Hydraulic Fracturing,"*Deformation of Sediments and Sedimentary Rocks*, Geological Special Publication 29, Jones and Preston, Ed's (1979), pp. 39-53.

Miller, T., "New Insights on Natural Hydraulic Fractures Induced by Abnormally High Pore Pressures," AAPG Bulletin 79, (1995), pp. 1005-1018.

Standing, M., et al., "Density of Natural Gas," AIME, 146, (1942), pp. 140-149.

Fertl, Walter, et al., *Studies in Abnormal Pressures*, Amsterdam, *Developments in Petroleum Science* 38, "The Geology of Abnormal Pore Pressures," (1994), pp. 19-49.

Chapman, R., "Abnormal Pore Pressures: Essential Theory, Possible Causes, and Sliding," *Studies in Abnormal Pressures, Developments in Petroleum Science*, 38 edited by W.H. Fertl, R.E. Chapman and R.F. Hotz (1994) pp. 51-91.

Heum, O.R., "A Fluid Dynamic Classification of Hydrocarbon Entrapment," *Petroleum GeoScience*, 2 (1996) pp. 145-158.

Davis, J.C., "Statistics Data Analysis Geology," 2$^{nd}$ Ed., John Wiley & Sons, Inc. USA (1986), pp. 176-204.

Chapman, R. "The Geology of Abnormal-Pore Pressure," *Studies in Abnormal Pressure, Development in Petroleum Science*, 38 edited W.H. Fertl, R.E. Chapman and R. H. Hotz (1994) pp. 19-49.

* cited by examiner

METHOD FOR MECHANICAL AND CAPILLARY SEAL ANALYSIS OF A HYDROCARBON TRAP

This application claims the benefit of U.S. Provisional Patent Application No. 60/731,095 filed on Oct. 28, 2005.

FIELD OF THE INVENTION

This invention relates generally to the field of hydrocarbon exploration and production, and more particularly to hydrocarbon system analysis. Specifically, the invention is a method for predicting total hydrocarbon column height and contacts in a hydrocarbon trap.

BACKGROUND OF THE INVENTION

Oil and gas deposits tend to occur in geological configurations called traps. Buoyant forces support an oil layer on top of the denser ground water, and similarly a gas layer floats on top of the oil layer. A trap is a geologic configuration that "seals" the hydrocarbon columns in place, preventing their escape. Such escape could result either from fracture of the seal due to hydrocarbon pressure or by capillary seepage through the seal. Such traps often contain commercial deposits of oil or gas. In evaluating such a trap, whether a prospect trap in the course of exploration or a trap of interest in the course of field development, the depths of the gas/oil contact and the oil/water contact are key quantities of interest. These contact depths will depend significantly on the seal capacity, i.e. the ability of the seal to resist fracturing and capillary seepage.

Understanding and predicting total hydrocarbon column height (difference in depth between the hydrocarbon-water contact and the top of the hydrocarbon column) and contacts in a hydrocarbon trap occupies the attention of every hydrocarbon exploration or production company. Seal capacity, which is the maximum hydrocarbon column height a seal can hold before leaking, is typically evaluated on a deterministic basis with little consideration of the substantial uncertainty associated with input parameters. Furthermore, the seal is typically evaluated for either mechanical seal capacity or capillary seal capacity without considering both simultaneously. Also, seal capillary entry pressure, the requisite input parameter for capillary seal capacity analysis, is usually directly measured by mercury injection capillary capacity tests on small pieces of rock. Results from these tests are not readily available everywhere, nor are they necessarily representative of adjacent rocks in the seal.

SUMMARY OF THE INVENTION

In one embodiment, the invention is a method for evaluating seal capacity in order to determine hydrocarbon column heights (and optionally associated probable errors) for a subject hydrocarbon trap containing oil, gas, or both oil and gas, said method comprising: (a) estimating a probability-weighted distribution for capillary entry pressure values at one or more calibration locations by equating capillary entry pressure with hydrocarbon buoyancy estimated through inversion of pressure data and trap geometry; (b) estimating a probability-weighted distribution for hydraulic fracture pressure values from calculations using theoretical calculation or from empirical data collected from one or more calibration locations; (c) obtaining probability-weighted distributions for anticipated fluid properties and trap geometry parameters at the subject hydrocarbon trap, said properties and parameters including:

(1) in-situ fluid (gas, oil, and brine) density;

(2) reservoir pressure;

(3) reservoir temperature;

(4) trap geometry, including crest and spill depths;

(d) determining a current realization value for each of the fluid properties and trap geometry parameters of the subject trap by randomly selecting from their respective probability-weighted distributions; (e) determining a current realization value for the subject trap's capillary entry pressure by: randomly selecting a capillary entry pressure value from the probability-weighted distribution determined for the one or more calibration locations; and adjusting the selected capillary entry pressure value by calculating interfacial tensions consistent with the subject hydrocarbon trap's pressure, temperature, and fluid composition selected for the current realization; (f) determining a current realization value for the subject trap's hydraulic fracture pressure by: randomly selecting a hydraulic fracture pressure value from the probability-weighted distribution determined by calculation or empirical data from one or more calibration locations; and adjusting the selected hydraulic fracture pressure value consistent with the trap crest depth selected for the current realization, thereby generating an adjusted fracture pressure gradient; (g) calculating a column height for each hydrocarbon phase (oil and gas) present in the subject trap using the randomly selected fluid properties and trap geometry parameters of the subject trap for the current realization, said calculation equating hydrocarbon buoyancy with total seal capacity, said total seal capacity being obtained by combining the adjusted hydraulic fracture pressure gradient and capillary entry pressure values determined for the current realization; (h) repeating steps (d)-(g) a predetermined number of times; and (i) averaging the results and optionally calculating an uncertainty for each column height from spread within the results.

In one embodiment of the invention, the step above of estimating a probability-weighted distribution for capillary entry pressure values at a calibration location comprises: (a) obtaining probability-weighted distributions for fluid properties and trap geometry parameters at the calibration location; (b) randomly selecting a current realization value for each said fluid property and trap geometry parameter from their probability-weighted distributions; (c) estimating gas entry pressure (GEP) from hydrocarbon column buoyancy using the current realization values of the fluid properties and trap geometry parameters; (d) optionally estimating implied mercury injection capillary pressure (MICP) using the current realization values of the fluid properties and trap geometry parameters and by calculating brine-gas interfacial tensions; (e) calculating oil entry pressure (OEP) from the gas entry pressure; and (f) repeating steps (b)-(e) a pre-selected number of times, averaging the results and estimating a probability-weighted distribution for GEP, OEP and, optionally, MICP.

In some embodiments of the invention, the theoretical calculation for estimating a probability-weighted distribution for hydraulic fracture pressure values uses critical-state soil mechanics to solve a minimum stress equation in which hydraulic fracture pressure is approximated by minimum horizontal stress.

The invention's method for determining capillary entry pressure may be used by itself in a deterministic calculation of capillary entry pressure for a hydrocarbon trap from hydrocarbon contact depths and fluid densities, the capillary entry pressure being specified by a gas entry pressure, an oil entry pressure and, optionally, a mercury-injection capillary pressure, the method comprising: (a) estimating gas entry pressure from groundwater aquifer buoyancy pressure on the hydrocarbon trap's hydrocarbon column, said buoyancy pressure being determined from the hydrocarbon contact depths and fluid densities; (b) calculating interfacial tension for a gas-water interface and for an oil water interface and, optionally, for a mercury-air interface, said interfacial tensions being calculated for conditions representative of the trap and its fluids; and (c) calculating oil entry pressure and, optionally, mercury-injection capillary pressure from the gas entry pressure and the interfacial tensions. In some embodiments, the buoyancy of the hydrocarbon column which is needed in the course of estimating gas entry pressure step is determined by steps comprising: (a) obtaining hydrocarbon depth and fluid density data from a measured interval (calibration location); (b) developing a black oil empirical model of hydrocarbon fluid properties; (c) selecting an aquifer composition model and gas equation of state that may be used to correct aquifer and gas densities for variations in pressure and temperature; (d) adjusting input parameters of the black oil model and the aquifer composition model to match measured in situ well bore fluid densities; (e) adjusting fluid gradients as a function of pressure and temperature within the trap using the said models to extrapolate away from the measured interval to the trap, yielding hydrocarbon and aquifer depth vs. pressure curves at the trap's structural crest; and (f) deducing hydrocarbon buoyancy pressure from differences between the aquifer depth-pressure curve and the hydrocarbon depth-pressure curve.

BRIEF DESCRIPTION OF THE DRAWINGS

The present invention and its advantages will be better understood by referring to the following detailed description and the attached drawings in which.

The invention will be described in connection with its preferred embodiments. However, to the extent that the following detailed description is specific to a particular embodiment or a particular use of the invention, this is intended to be illustrative only, and is not to be construed as limiting the scope of the invention. On the contrary, it is intended to cover all alternatives, modifications and equivalents that may be included within the spirit and scope of the invention, as defined by the appended claims.

DETAILED DESCRIPTION OF PREFERRED EMBODIMENTS

The present invention is a method for predicting mechanical and capillary seal capacity in tandem, and propagating input parameter uncertainties to predict the probable error of the result. The present invention also discloses a method for predicting top-seal capillary entry pressure based on inversion of readily observed trap and hydrocarbon column-height parameters combined with fluid gradients estimated from commonly available fluid and physical properties data.

The present invention recognizes that predictions of total hydrocarbon column height and contacts in a hydrocarbon trap require combined evaluation of capillary and mechanical seal properties, careful evaluation and quantification of uncertainties, and the propagation of these uncertainties through the analysis. It is a premise of the present invention that a seal should be evaluated for mechanical seal capacity and capillary seal capacity simultaneously, and that this is a requirement for robust hydrocarbon column height and fluid contact predictions.

In the present inventive method, attention is focused on trap-scale controls on hydrocarbon contacts. Accordingly, hydrocarbon contact predictions are sensitive to trap geometry (including sand connectivity resulting from structural and stratigraphic controls) and hydrocarbon-leak potential. The present inventive method is concerned with the evaluation of hydrocarbon leakage from a trap with a known geometry. It may be effectively used as a tool to help quickly evaluate trap geometry and connectivity scenarios, propagating uncertainty through statistical calculations. It is thus appropriate to use the present inventive method to, among other applications, evaluate the validity of hydrocarbon contacts for trap geometry scenarios, explore the consequences of direct hydrocarbon indicators or proposed pre-drill fluid contacts, or to calculate implied seal capacities in reservoirs in which the contacts and trap geometry are fairly well constrained. Following is a brief review of the theoretical basis of the present inventive method.

Fluid Pressure

Figure 1:
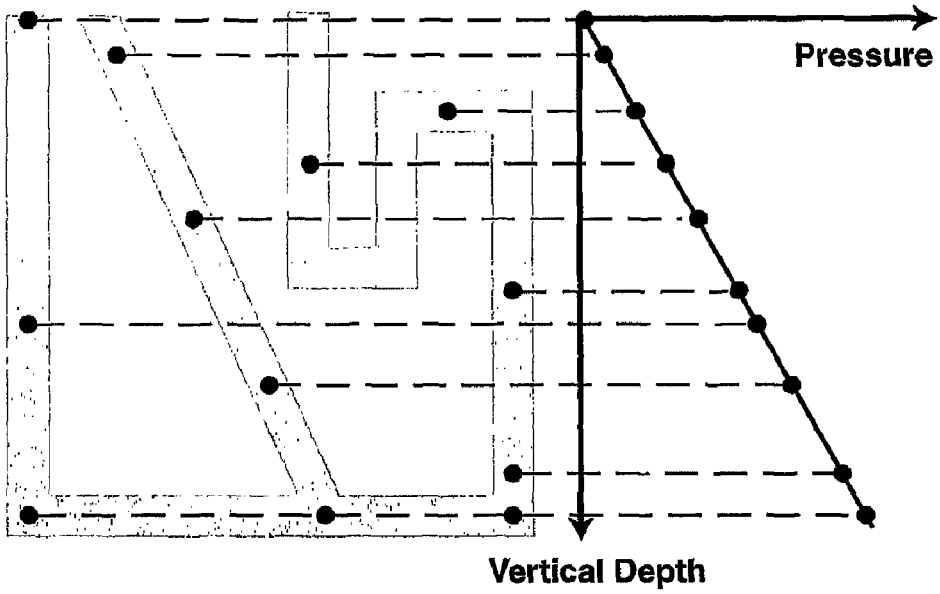
FIG. 1 (Prior Art)
FIG. 1 illustrates that hydrostatic pressure depends only on depth and fluid density and is independent of container shape.

A complete description of subsurface hydrodynamics is not presented because this depth of detail will be known or readily available to persons skilled in the art from familiarity with references such as two articles by Chapman in *Studies in Abnormal Pressure*, Fertl, W. H., Chapman, R. E. and Holz, R. F., Eds., Elsevier, Amsterdam, *Developments in Petroleum Science* 38 (1994): "The Geology of Abnormal Pore Pressures," 19-49; and "Abnormal pore pressures: Essential theory, possible causes, and sliding," 51-91. A few key fundamental concepts and definitions are helpful for the discussion that follows. Normal or hydrostatic pressure is defined as the pressure exerted by a static column of water from the surface to the depth of interest. FIG. 1 illustrates that such pressure depends only on vertical depth (and fluid density) regardless of the shape of the container. The rate of change of pressure with depth, or pressure gradient, is a function of the fluid density. In the case of subsurface brines, hydrostatic pressure gradients range between 0.42 and 0.47 psi/ft depending on brine salinity and pressure (as brine is slightly compressible).

Figure 2:
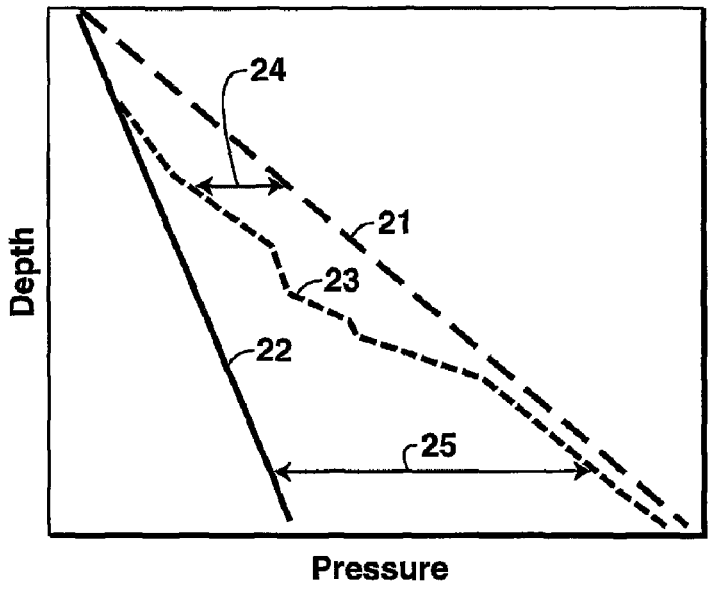
FIG. 2 (Prior Art)
FIG. 2 illustrates the meaning of typical terms used to describe subsurface pressures.

The pressure at any depth resulting from the weight of the overlying sediments is termed the lithostatic or overburden pressure or stress. Typical lithostatic pressure gradients range between 0.7-1.2 psi/ft. In a hydrostatic system, the overburden stress is transmitted by the grain-grain contacts in the sediments and the hydrostatic stress is transmitted by the brine within the interconnected pore network. The overburden stress causes the sediment to compact, collapsing the pore network and expelling brine from the pore space. In low permeability sediments, brine expulsion is impeded, so the pore fluid may begin to support some of the overburden stress causing the pore pressure to be elevated above hydrostatic. The portion of the overburden stress supported by the grain-grain contacts in the rock is termed the effective stress and the portion supported by the pore fluid is termed the overpressure (or excess pressure). FIG. 2 is a graph of overburden stress 21 relative to hydrostatic (normal) pressure 22. Pore pressure is indicated by 23. Thus, effective stress 24 and overpressure (excess pressure) 25 may be read from the graph.

Practically, pore pressures approach a mechanical limit somewhat less than the lithostatic pressure or stress ($\sigma_L$) called the fracture pressure ($P_f$), or the fluid pressure at which hydrofractures begin to form in a rock. This can be seen in FIG. 2. The magnitude by which $\sigma_L$ exceeds $P_f$ depends on the orientation of maximum compressive stress ($\sigma_1$). In extensional or quiescent environments, $\sigma_L=\sigma_1$ and $P_f=\sigma_L$, whereas in contractional settings, $\sigma_L\neq\sigma_1$ and $P_f\approx\sigma_L$.

It is important to recognize that over-pressured systems are dynamic and high overpressure means a high potential for brine flow. The magnitude of the pore pressure will depend on the burial rate (increasing the overburden stress), the stratigraphy, and the rate of brine expulsion. So systems with a high burial rate and/or a low permeability will tend to generate higher excess pressures and lower effective stresses.

Figure 3:
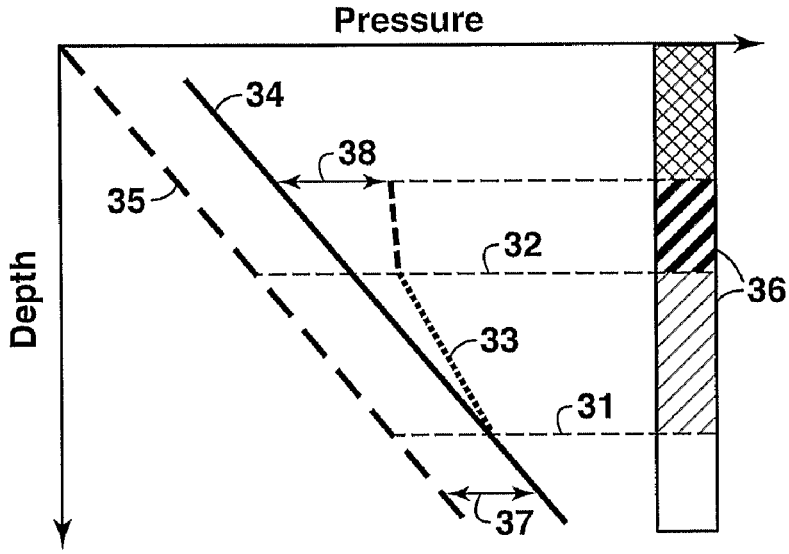
FIG. 3 (Prior Art)
FIG. 3 illustrates that low hydrocarbon density relative to water creates a slower decrease in pressure with shallowing depth within hydrocarbon columns.

In multiphase fluid systems, density differences between phases lead to buoyant segregation of fluid phases (FIG. 3). In hydrocarbon systems, hydrocarbon liquids and gases, being less dense than formation brines, will have a lower pressure gradient and higher absolute pressures than the aquifer. This pressure difference is a function of the hydrocarbon density and column height (the vertical height of the different hydrocarbon fluid phases in the trap) and is the measure of the fluid potential for secondary hydrocarbon migration. Typical hydrocarbon pressure gradients are ~0.3 psi/ft for oil and ~0.1 psi/ft for gas. In FIG. 3, the oil-water cutoff (interface) is 31 and the gas-oil cutoff is 32. Line 33 shows the more gradual decline in pressure with decreasing depth within the hydrocarbon column 36 as compared to a hypothetical water column represented by line 35 which represents hydrostatic pressure alone, and line 34 which shows the increased pressure, called overpressure 37, due to the weight of the overburden. Line 38 denotes the buoyant pressure. The pressure gradient in each medium is the slope of the respective pressure vs. depth line.

Mechanical Seal Capacity

Mechanical seal capacity refers to the size of the hydrocarbon column that achieves a hydraulic pressure at the top of column equaling or exceeding the hydraulic fracture pressure of the overlying seal. At mechanical seal capacity hydrocarbons migrate through the seal at the top of column. A complete description of subsurface mechanical seal capacity is not presented because this depth of detail will be known or readily available to persons skilled in the art. For a description of rock fracture mechanics models, see, for example, Simmons and Rau, "Predicting Deepwater Fracture Pressures: A Proposal," paper SPE 18025, 1988 SPE Annual Technical Conference and Exhibition, Houston, Oct. 2-5; or Rocha and Bourgoyne, "A new simple method to estimate fracture pressure gradient," *Pore pressure and fracture gradients* [Serial] SPE Reprint Series, 101-107 (1999). Following are a few key fundamental concepts and definitions.

Hydraulic seal failure is typically associated with three geologic environments:

Shallow reservoirs

Highly over pressured reservoirs

Very large hydrocarbon columns

The key parameter controlling hydraulic seal failure is the minimum effective stress. The effective stress is defined as the difference between the minimum principal compressive stress and the pore fluid pressure. The minimum compressive stress is commonly horizontal, but can be oriented in different directions depending on the geologic environment. Hydraulic seal failure occurs when the effective stress in a particular portion of the stratigraphic section approaches zero (approaches a tensile regime). The vertical compressive stress (due to overburden) always increases with depth in sedimentary basins, but the effective stress may increase or decrease with depth due to other factors.

At low effective stress, small disturbances in the stress field can hydraulically fracture or re-open fractures in the top seal and result in hydrocarbon leakage. The increase in fluid pressure caused by hydrocarbon migration into a trap can be enough to fracture the top or fault seal. When fracturing occurs, hydrocarbons will leak from the trap until the fluid pressure drops below the minimum principal compressive stress, which then allows the fractures to close and the leakage to cease. In general, hydraulic top or fault seal failure is not catastrophic, and the traps do not lose all hydrocarbons.

To evaluate hydraulic leakage risks, some measure of hydrocarbon column height, hydrocarbon density, aquifer pressure, and fracture pressure is required. There are several methods for estimating fracture pressure, or fracture gradient, including:

Minimum Stress Methods: these are commonly used methods in which the fracture pressure is approximated by the minimum horizontal stress ($\sigma_{h\ min}$).

Minimum stress methods assume stable relationships between horizontal and vertical stresses that depend on rock properties;

During burial and compaction of sediments (during which vertical effective stress at maximum value):

$$\sigma_{h\ min}=k_o(\sigma_1-P_{pore})+P_{pore}=k_o\sigma_{eff}+P_{pore}$$

where $\sigma_{h\ min}$=the minimum horizontal stress, $$k_o=\frac{\sigma_3-P_{pore}}{\sigma_1-P_{pore}}$$

(for a uniaxial compressive state where compaction is in one direction with no lateral strains)=ratio of minimum and maximum effective stress, 0.4 for strong materials to >0.8 for shale/clay, $\sigma_1$=the vertical stress, taken as the sediment overburden pressure at the depth of interest, and $P_{pore}$=pore pressure.

Hoop Stress Methods: these methods are based on analytical solutions for stresses in a plate with a circular hole (e.g., a wellbore). They predict lost returns when the wellbore pressure causes the hoop stress along the wellbore wall (or the stress tangential to the wellbore) to equal the rock's tensile strength.

Fracture Mechanics Methods: these methods take detailed information about fracture toughness, initial crack length, and fluid pressure distribution along a crack, and use that information to determine the conditions under which fracture propagation will begin and end. They are used to design hydraulic fracturing treatments.

Empirical methods: Minimum horizontal stress is sometimes approximated by a best-fit to empirical measures of the compressive stress (formation integrity test, FIT; leak-off test, LOT; pressure integrity test, PIT; or production data).

In complex tectonic environments, detailed estimation of fracture gradient may require application of multiple approaches. In many settings, however, a minimum horizontal stress method provides adequate estimates, and its required input parameters are commonly available. Therefore, it is one of the two fracture gradient estimation methods, along with empirical approaches, that are used in preferred embodiments of this invention, as described in detail below.

Capillary Seal Capacity

A complete description of subsurface capillary seal capacity is not presented (except for innovations of the present invention) because this depth of detail will be known or readily available to persons skilled in the art. Following are a few key fundamental concepts and definitions.

Hydrocarbons move through water-saturated porous rocks due to buoyancy. Work is required to increase the surface area of a hydrocarbon filament so it can displace water in the pore space of finer-grained rocks. This results in a resistance to hydrocarbon movement. The magnitude of this resistance is a function of the size of the smallest pore throat in the connected pathway, wettability, and the interfacial tension between hydrocarbon and brine. See, for example, Berg, R. R., "Capillary pressure in stratigraphic traps," AAPG Bulletin 59, 939-956 (1975); and Schowalter, T. T., "Mechanics of secondary hydrocarbon migration and entrapment," AAPG Bulletin 63, 723-760 (1979). The "capillary entry pressure" (Pc), also called the "displacement" or "threshold" pressure, quantifies the magnitude of the resistant force for low flow rates. See, for example, Smith, D. A., "Theoretical considerations of sealing and non-sealing faults," AAPG Bulletin 50, 363-374 (1966).

Figure 4:
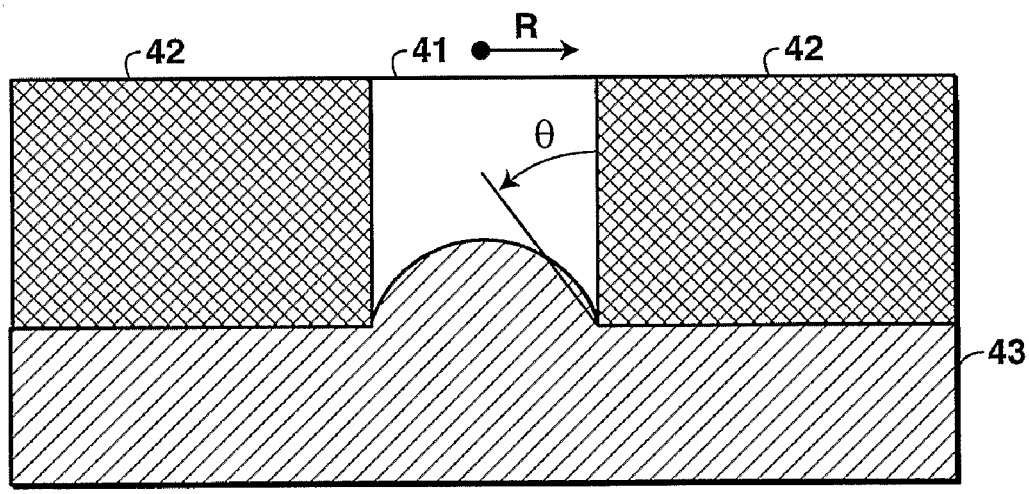
FIG. 4 (Prior Art)
FIG. 4 illustrates capillary wetting angle in a pore throat.

The relevant physics is depicted in FIG. 4. Small pore throats 41 within the finer-grained sealing unit 42 impede hydrocarbon flow so that the underlying hydrocarbon column 43 increases. As the hydrocarbon column increases, the buoyancy of the hydrocarbon column increases the pressure difference between the wetting and non-wetting phase, forcing the hydrocarbons into the water-saturated pore throat. The equilibrium hydrocarbon-brine-solid contact is at the wetting angle. When the hydrocarbon column height is sufficient for the buoyancy force to equal the capillary entry pressure of the seal, hydrocarbons may enter the pore throat 41, deforming the immiscible boundary between the phases into a shape that fits between the pore throats of the sealing unit.

When two immiscible fluids contact a solid surface, one phase is preferentially attracted to the sold. Wettability is expressed mathematically by the contact angle (wetting angle) of the oil-water interface against the rock. This angle depends on the degree of preferential attraction or, put another way, the work needed to separate a wetting fluid from a solid. In some embodiments of the present invention, it is assumed that rock grains in natural systems are water wet, meaning that grains are coated by a thin water film.

Interfacial tension is an expression of the work required to enlarge by unit area the interface between two immiscible fluids. This tension results from the difference between the mutual attraction of like molecules within each fluid and the attraction of dissimilar molecules across the fluid interface.

The upward pressure $P_c$ resulting from the buoyancy force on the hydrocarbons is given by $$P_c = \frac{2\eta\cos\theta}{R}$$

where η is the hydrocarbon-water interfacial tension, θ is the wetting angle at breakthrough, and R is the pore throat radius.

Model for Prediction of Contact Elevations

Trap configuration combined with capillary entry pressure and hydraulic fracture gradient is sufficient to determine the location of present-day hydrocarbon contacts if various assumptions including the following are satisfied:

(a) The present-day "geology" (geometry, rock properties, etc) is sufficient to solve the problem. This implies that the charge rates are generally high compared to deposition rates. This assumption is not always valid, but experience indicates that this assumption usually does not lead to significant errors. This assumption is most likely to be valid for old traps and/or systems with recent hydrocarbon charge.

(b) Volumes of oil and gas sufficient to fill the accumulation have been generated from the source and migrated to the trap (i.e., the trap is not charge-limited for oil or gas).

(c) The hydrocarbon distribution is at a quasi steady-state equilibrium condition. According to this assumption, migration is fast on a geological time scale and the final hydrocarbon distribution is not a function of the total charge volume (except that the trap is not charge limited as stated above). The distribution of fluids is controlled by capillary forces and is independent of the permeability. (Capillary forces and permeability are not totally independent, but in this model only the capillary forces are needed.) This assumption means that at present day, the charge rate of fluids into the trap is equal to the sum of the leakage and spillage rates from the trap.

(d) Capillary leakage occurs at the point of highest buoyancy force for the leaking phase. (If a trap leaks gas, it leaks at the crest; if a trap leaks oil, it leaks at the gas-oil contact.) This has the same effect as the slightly more restrictive assumption that the seal has uniform capillary properties.

(e) Hydraulic fracture leakage occurs at the top of the hydrocarbon column (trap crest).

(f) The capillary (entry) pressure of the seal is not a function of fluid saturations in the seal or the flux rate of fluids through the seal. The seal capillary capacity changes only due to changes in brine-hydrocarbon interfacial tension. This assumption means the hydrocarbon distribution is not a function of the system charge rate.

(g) The contact angle is zero for oil-water and gas-water systems (i.e., seals are completely water wet).

(h) The water phases in the seal and the trap have similar excess pressures. Higher excess pressures in the seal increase the effective seal capacity because the buoyancy force of the hydrocarbon column must exceed the excess pressure as well as the capillary entry pressure. Lower excess pressures in the seal decrease effective seal properties by providing an additional driving force for hydrocarbon movement. See, for example, Heum, O. R., "A fluid dynamic classification of hydrocarbon entrapment," *Petroleum Geoscience* 2, 145-158 (1996).

If the hydrocarbons are in the two-phase region (in P-T space) and given the above assumptions, there are six possible leakage scenarios. These six cases are illustrated in FIGS.

Figure 5A:
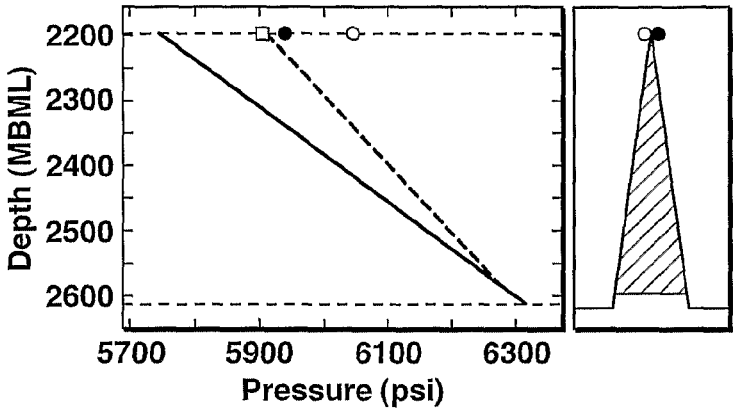
FIGS. 5A-F depict various possible cases of contact and capillary/mechanical leakage relationships.

5A-F. In the vernacular of the Sales classification system, Case 6 (FIG. 5F) is equivalent to a Sales Class 1 trap, Case 4 (FIG. 5D) is equivalent to a Sales Class 2 trap, and Case 2 (FIG. 5B) is equivalent to a Sales Class 3 trap. Case 1 (FIG. 5A) is not possible to realize with capillary leakage alone, so there is no equivalent in the Sales classification system. See Sales, J. K., "Seal strength vs. trap closure—A fundamental control on the distribution of oil and gas," in, *Seals, Traps, and the Petroleum System*, R. C. Surdam, ed., AAPG Memoir 67, 57-83 (1997). Cases 2 and 3 (FIG. 5C) and Cases 4 and 5 (FIG. 5E) are not possible to distinguish with hydrocarbon column heights alone.

FIGS. 5 A-F are similar in what they show to FIG. 3. Each drawing has one line showing water pressure vs. depth and a second line showing the more gradual increase of pressure with depth in the hydrocarbon column. Where the hydrocarbon column includes both gas and oil phases, the second line consists of two line segments with different slopes. (FIGS. 5 B, C, D and E) In FIG. 5A, the hydrocarbon column is all oil (narrow stripes) and in FIG. 5F it is all gas (wide stripes).

In case 1 (FIG. 5A), the buoyancy pressure of the hydrocarbon column exceeds the seal fracture pressure. Both oil and gas leak at the crest by hydraulic fracturing and trap completely filled with oil. In the limit where the aquifer pressure at the crest approaches the fracture pressure ($P_f$), the oil column height approaches zero.

In case 2 (FIG. 5B), the buoyancy pressure of hydrocarbon column exceeds the gas entry pressure ("GEP") at the crest and the buoyancy of the oil leg exceeds the oil entry pressure ("OEP") at the gas-oil contact ("GOC"). Gas and oil leak by capillary breakthrough separately at the crest and at the elevation of the GOC.

Figure 5B:
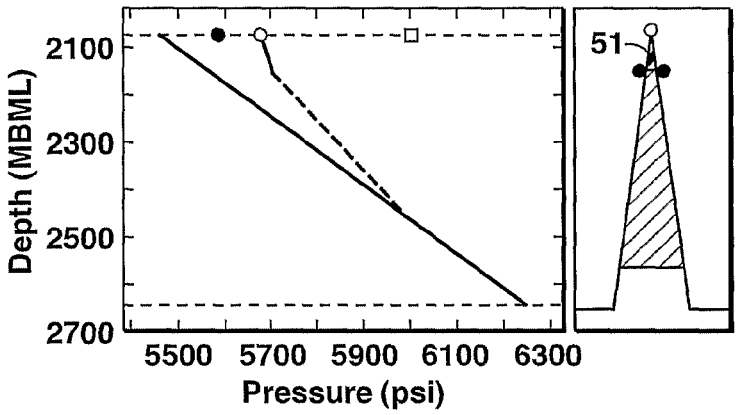
Figure 5C:
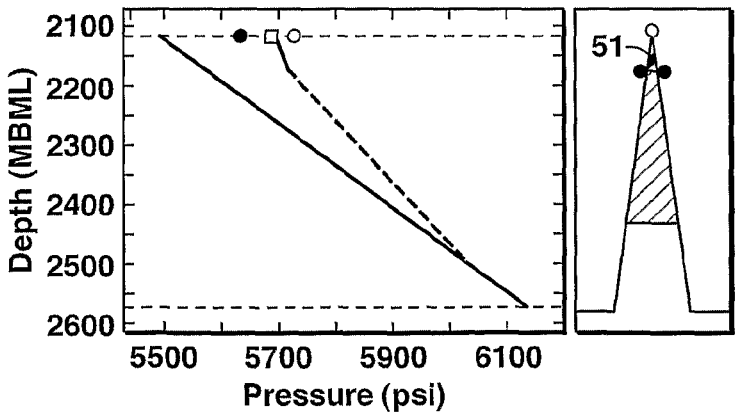
Figure 5D:
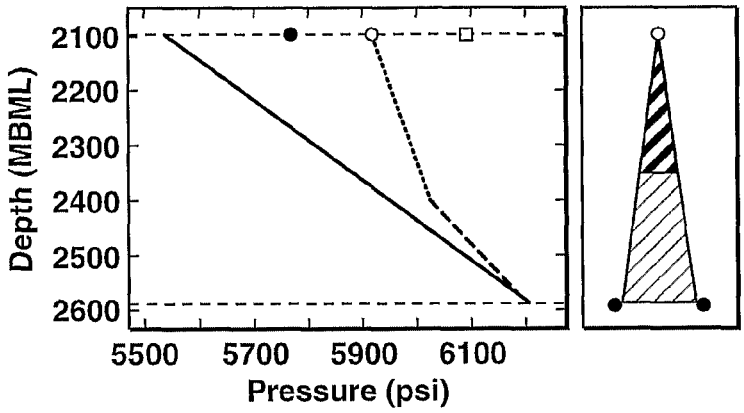
Figure 5E:
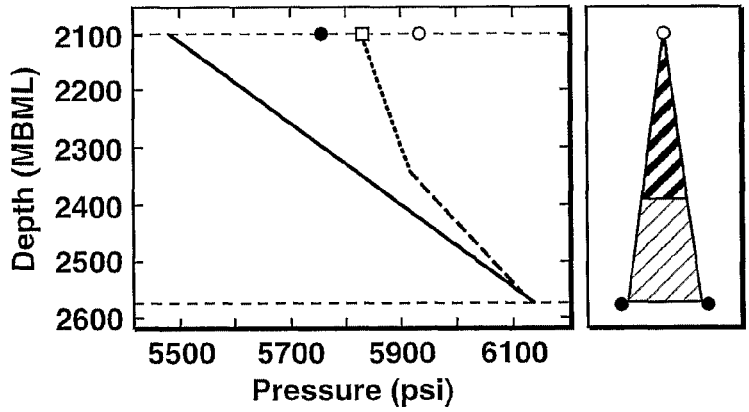
Figure 5F:
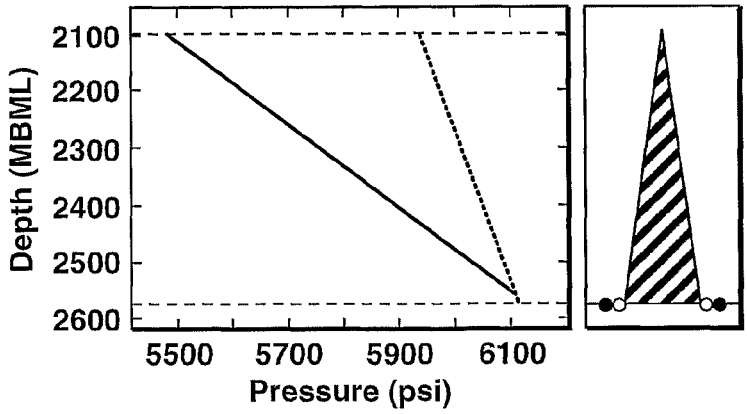

In case 3 (FIG. 5C), the buoyancy pressure of the hydrocarbon column exceeds the $P_f$ at the crest and the buoyancy of the oil leg exceeds the OEP at the GOC. Gas hydraulic leakage occurs at the crest and oil capillary leakage occurs through the topseal at the elevation of the GOC. Leakoff and the OEP pressure control the GOC and the oil-water contact ("OWC"). The small gas column at the top of the hydrocarbon column in FIGS. 5B and 5C is indicated by 51.

In case 4 (FIG. 5D), the buoyancy pressure of the hydrocarbon column exceeds the GEP at the crest, but the buoyancy of the oil leg does not exceed the OEP at the GOC. Gas capillary leakage occurs at the crest and oil spills from the trap. GEP and closure height control GOC and OWC.

In case 5 (FIG. 5E), the buoyancy pressure of the hydrocarbon column exceeds the $P_f$ at the crest, but the buoyancy of the oil leg does not exceed the OEP at the GOC. Gas hydraulic leakage occurs at the crest and oil spills from the trap. $P_f$ and closure height control the GOC and OWC.

In case 6 (FIG. 5F), the buoyancy pressure of an all gas column is less than the $P_f$ or the GEP. There is no leakage, both gas and oil spill from the trap, and the only fluid phase within the trap is gas.

Basic Method

Figure 6:
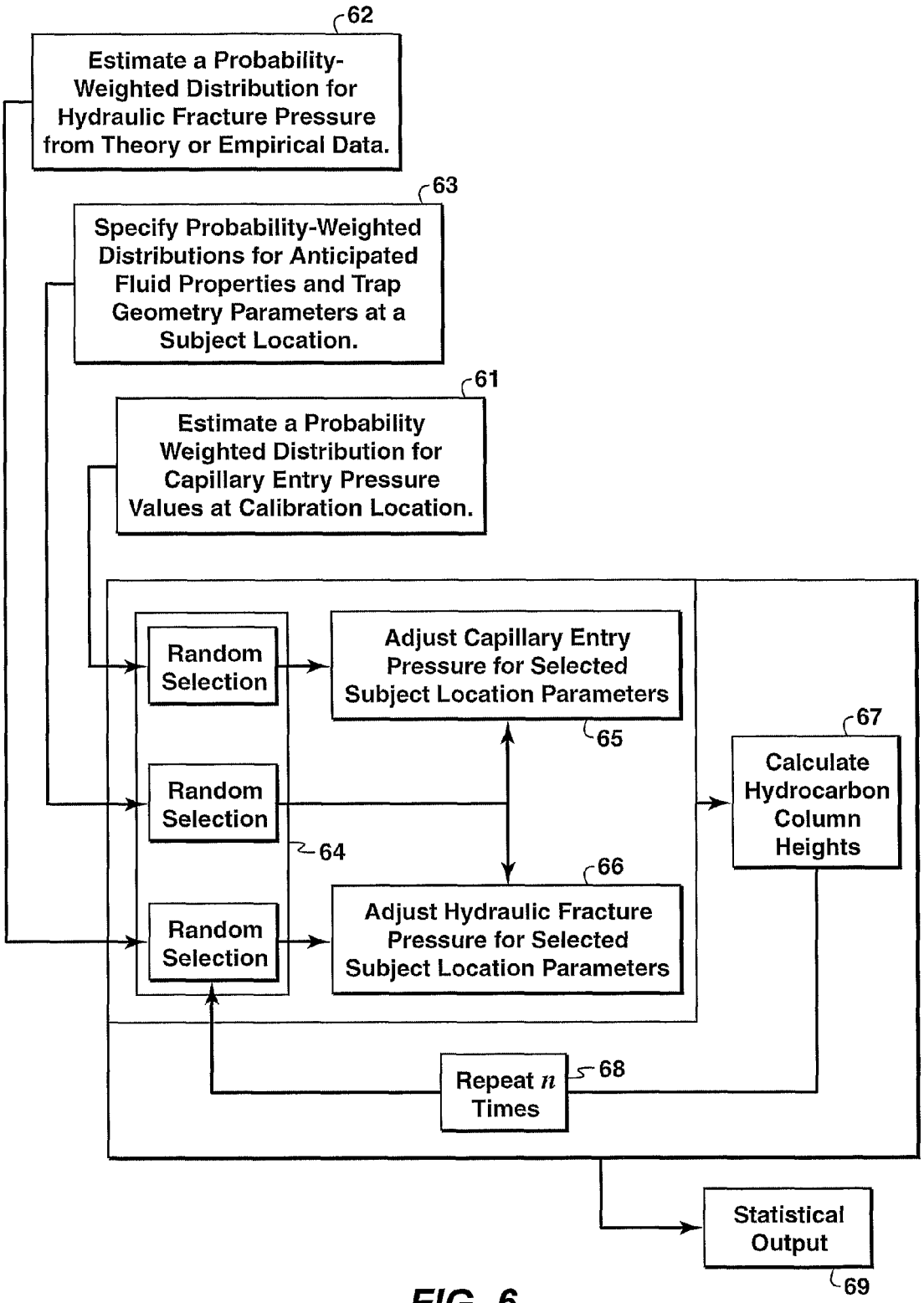
FIG. 6 is a flowchart showing basic steps of one embodiment of the present inventive method.

FIG. 6 is a flowchart showing basic steps for one embodiment of the present inventive method. First, a brief description of the steps of the method is given, followed by treatments of some steps in more detail.

At step 61, a probability-weighted distribution is estimated for capillary entry pressure values at a calibration location (as contrasted with the location of the prospect trap that is the subject of the evaluation). Possible alternatives for performing this step include: a) performing standard laboratory Mercury Injection Capillary Entry Pressure (MICP) experiments on a representative sampling of seal rocks from a calibration location, or b) calculating a value for MICP implied by hydrocarbon column heights at a calibration location (this preferred method is described in more detail below).

Step 62 is estimating a probability-weighted distribution of hydraulic fracture pressure values (i.e., a fracture gradient) at a calibration location. Possible alternatives for performing this step include:

(a) Best Fit to Leak-off Test Data. Estimate hydraulic fracture gradient by deriving a best fit to leak-off pressure test data using a linear regression algorithm (described further below).

(b) Geomechanical Theory. Estimate the hydraulic fracture gradient using critical-state soil mechanics method incorporating externally derived overburden and pore pressure estimates, and a $k_o$ value (lithology dependent horizontal to vertical stress ratio) estimated from regional experience, and/or rock type, and/or burial history (described further below).

Step 63 is estimating a probability-weighted distribution for trap and fluid parameters at a prospect location, most likely based on expert opinion.

(a) Trap parameters (best estimate plus associated uncertainty ranges)
  i) Depth of the trap crest
  ii) Depth of the trap spill and/or controlling fault juxtaposition leaks.
  iii) Trap temperature (b) Fluid parameters
  i) In-situ fluid (hydrocarbon, brine) density.
  ii) Formation aquifer pressure The remaining steps concern the probabilistic analysis, for which the preceding steps provide input. The probabilistic analysis is also discussed in more detail below. Step 64 is randomly selecting from the three probability-weighted distributions from steps 61-63 a capillary entry pressure value, a hydraulic fracture pressure value, and a value for each of the trap and fluid properties. The capillary entry pressure is derived from a calibration location where the hydrocarbon contacts are known. In step 65, the selected capillary entry pressure value is adjusted for interfacial tensions consistent with pressure, temperature, and fluid properties selected to be representative of the subject (prospect or development) trap. In step 66, the selected hydraulic fracture pressure is adjusted for a selected crest depth believed to be representative of the subject trap. At step 67, hydrocarbon column heights are calculated consistent with the selected trap parameters, fluid parameters, and mechanical seal capacity parameters. One random realization is now complete. At step 68, steps 64-67 are repeated a predetermined number of times, thus generating the desired number of random realizations. At step 69, the stochastic results are ready for analysis by the data interpreter.

Estimating Capillary Entry Pressure (Step 61)

Steps 61 and 62 in the FIG. 6 flowchart call for calculating a probability-weighted distribution of capillary and mechanical seal capacities based upon observations obtained at one or more calibration locations. These distributions are adjusted to conform to expected conditions at a subject location. The following discussion discloses a preferred method for determining the probability-weighted distribution of capillary seal capacity from a calibration location. The method may be repeated several times if multiple calibration locations are available. Favorable calibration locations for capillary seal capacity analysis are preferably selected based upon the following criteria:

(a) The calibration location and the subject location should be in the same geographic area.

(b) The components of the trap configuration of the calibration location listed below as required input quantities should be well constrained.

(c) The top seal (the rock type through which hydrocarbons leak) of the calibration location should be similar to the subject top seal in terms of lithology, texture, and effective stress.

In the afore-mentioned preferred embodiment of the present inventive method, the seal capillary entry pressure is estimated by inversion of commonly available hydrocarbon trap and fluid property data. This technique is a significant departure from the existing petroleum industry practice of directly measuring capillary-entry pressure by mercury injection (MICP) or other techniques. These existing techniques depend on availability of rock samples that are representative of the weakest element of the seal or comparisons to global databases. The method disclosed herein results in an estimate of seal capillary-entry pressure for the weakest element of the seal without specific identification of that element.

This method extends a model disclosed by Sales for hydrocarbon leakage based on known subsurface fluid contacts, trap parameters, and fluid compositions for application to the exploration scale. See Sales, J. K., "Seal strength vs. trap closure—A fundamental control on the distribution of oil and gas," in *Seals, Traps, and the Petroleum System*, R. C. Surdam, ed., AAPG Memoir 67, 57-83 (1997). This empirical model may be used to estimate the capillary seal capacity necessary for hydrocarbon leakage to occur out of a trap with a given closure height (so-called "implied" MICP).

A premise of the present invention's method for estimating capillary seal capacity is that the most reliable estimates of seal capacity are implied values from pressure data. An implied gas entry pressure (GEP) assumes that the GEP is equal to the buoyancy forces of the hydrocarbons in a trap that is leaking gas or gas and oil. If the trap is not leaking, then the calculated value will be a minimum implied GEP instead of a most likely implied GEP.

According to a quasi-steady-state equilibrium model, capillary seal strength is related directly to the buoyancy pressure applied by the hydrocarbon column to the top seal. The buoyancy pressure at the crest is less than the seal capacity for Case 6 traps and equal to the gas entry or threshold pressure for Case 2 or 4 traps (See FIGS. 5A-F). The buoyancy pressure exerted by the oil column at the gas-oil contact is equal to the oil entry or threshold pressure for Case 2 or 3 traps. The gas or oil entry pressure may be related to the seal capacity if oil-brine and gas-brine interfacial tensions are known.

For gas entry pressure (GEP) estimation in this embodiment of the present inventive method, the following probability-weighted distributions are obtained and used:

depth to the top of the hydrocarbon column ($D^{CTOC}$).

depth to the gas-oil contact ($D^{CGOC}$).

depth to the oil-water contact ($D^{COWC}$).

in-situ gas density ($\rho_G$).

in-situ oil density ($\rho_O$).

in-situ brine density ($\rho_B$).

For oil entry pressure (OEP) estimation in this embodiment of the present inventive method, the following probability weighted distributions are obtained and used:

reservoir temperature ($T^{CGOC}$) at $D^{CGOC}$.

gas pressure ($P_G^{CGOC}$) at $D^{CGOC}$.

probability-weighted distribution of the Z factor (Z) (See, for example, Standing, M. B. and Katz, D. L., "Density of natural gases," Trans. AIME 146, 140-149 (1942)).

Figure 7:
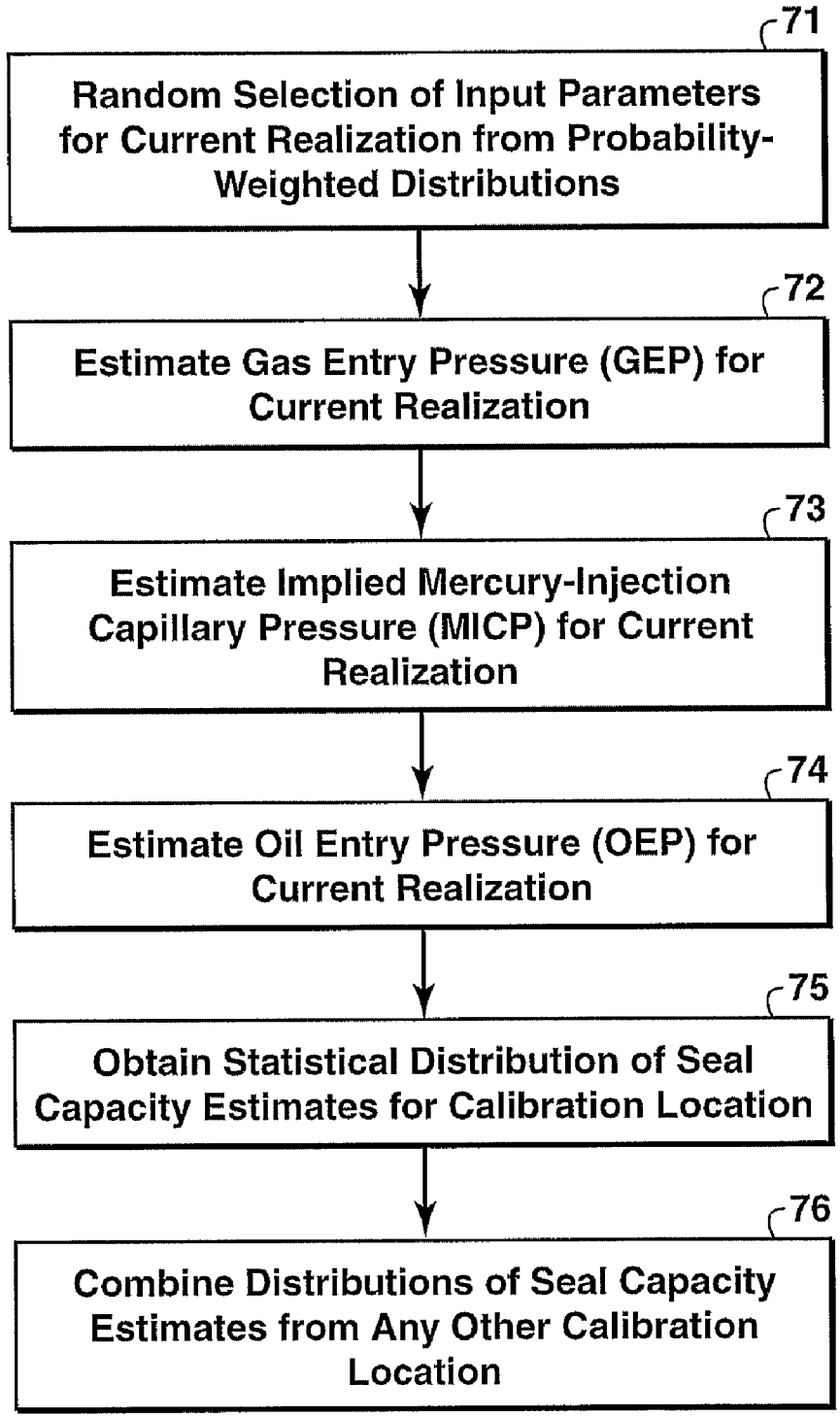
FIG. 7 is a flowchart of basic steps in one embodiment of the present invention's method for estimating a probability-weighted distribution for capillary entry pressure.

The flowchart of FIG. 7 shows basic steps for performing step 61 of FIG. 6 for this embodiment of the present inventive method:

Step 71: Random Selection of Input Parameters

A single value of each required input quantity is randomly selected from the probability-weighted distribution for such parameter to generate the input values for the current realization.

Step 72: Estimate Gas Entry Pressure (GEP) for Current Realization

The GEP (gas entry pressure) is determined from contact elevations, trap geometry, and pressure gradients alone, and may be used for predictions at sites with similar pressure and temperature (P-T) conditions.

To estimate the buoyancy pressure exerted by trapped hydrocarbons within the structure, a black-oil model (a well known empirical model of hydrocarbon fluid properties) may be used to (1) correct fluid gradients for changes in pressure and temperature away from the measured interval (an untypical application of the black-oil model) and (2) correct measured fluid gradients measured in offset drilling to compensate for changes in temperature and pressure at the prospect of interest (a standard application). An aquifer composition model (salinity) and gas equation of state may be used to correct aquifer and gas densities for variations in pressure and temperature. Non-ideality (in the gas equation of state) is specified by the Z factor, which may be determined iteratively. An alternative method for correcting fluid properties for pressure, temperature, and fluid composition is that of an EOS (Equation of State) model. Such models are readily available to practitioners in the field and they provide one example of an approach that could be used as an alternative to the black oil model methodology developed below or another empirical approach or other method for performing this step.

This preferred embodiment of the invention operates by first manually adjusting input parameters of the black-oil model and aquifer composition model to match measured in-situ fluid densities from the wellbore. Next, the fluid gradients are adjusted as a function of absolute pressure and temperature within the trap using the calibrated models to extrapolate away from the measured interval, i.e. the depth range over which pressure data was collected. The results are curves that may be used to estimate hydrocarbon and aquifer pressure at the structural crest. The difference between the extrapolated aquifer depth-pressure curve and the extrapolated hydrocarbon depth-pressure curve at the crest of the trap is a measure of the buoyancy pressure exerted by the hydrocarbons at the structural crest.

The gas entry pressure at the depth of the top of the hydrocarbon column at the calibration location ($D^{CTOC}$) may thus be estimated from the buoyancy of the hydrocarbon column by:

$$GEP^{CTOC}=\rho_B g(D^{COWC}-D^{CTOC})-[\rho_O g(D^{COWC}-D^{CGOC})+\rho_G g(D^{CGOC}-D^{CTOC})]$$

The oil entry pressure ("OEP") may then be calculated from the GEP and hydrocarbon-brine interfacial tension. The MICP may be calculated in a similar way. This calculation requires an estimate of the gas-brine interfacial tension. Interfacial tension is calculated from the Firoozabadi Tau, an empirical relationship between hydrocarbon-brine density difference and interfacial tension:

$$\tau=e^{(0.091251n(\Delta\rho)^2-0.538331n(\Delta\rho)+1.227328)},$$

where $\Delta\rho$ is the hydrocarbon-brine density difference.

The Firoozabadi Tau may be used to estimate hydrocarbon-brine interfacial tension through the relationship:

$$\eta_{B\text{-}HC}=[\Delta\rho_{B\text{-}HC}(T_{pr}^{HC})^{-0.3125}\tau]^4,$$

where $T_{pr}^{HC}$ is the pseudo-reduced temperature (calculated from the black-oil correlations—see below). In this equation, density is expressed in g/cc, pseudo-reduced temperature is dimensionless, and the interfacial tension is in dynes/cm. The same relationship between variables holds for the interface between any two substances, e.g., mercury and air. The factor $\tau$ in the expression for interfacial tension may also be considered to have indices because the density difference $\Delta\rho$ in the expression above for $\tau$ refers to the density difference between the particular two fluids for which the interfacial tension is being calculated. Once the hydrocarbon-brine interfacial tension and entry pressure are known, seal capacity may be estimated according the relationship:

$$\frac{MICP}{\eta_{Hg\text{-}air}\cos\theta_{Hg\text{-}air}} = \frac{OEP}{\eta_{B-O}\cos\theta_{B-O}} = \frac{GEP}{\eta_{B-G}\cos\theta_{B-G}}$$

where $MICP=P_{Hg}-P_{air}$, $OEP=P_o-P_w$, $GEP=P_g-P_w$, and $\theta_{ij}$ is the contact angle for i and j fluid system.

Input Data for Some Embodiments of the Present Inventive Method:

- Trap parameters (crest depth, spill depth (syncline, fault juxtaposition leak, or thief sand), temperature at crest)
- Fluid gradients (oil, gas, water gradients from RFT data or derived by technique outlined above)
- Hydrocarbon column heights or contact depths (e.g., direct hydrocarbon indicators, AVO, well penetrations)

These steps will now be explained in more detail. (Note: the terms water and brine are used interchangeably in the interfacial tension discussions.)

Step 73: Estimate Implied Mercury-Injection Capillary Pressure (MICP) for Current Realization (Note: Capillary entry pressure for the seal of a hydrocarbon cap is normally specified by the gas entry pressure (GEP) and the oil entry pressure (OEP), or just one of these if the trap contains only one hydrocarbon phase. However, MICP is often desired and useful also, primarily to enable comparisons to laboratory tests.)

(1) A gas specific gravity at $D^{CTOC}$ is found to match observed gas leg pressures using a black oil model (empirical correlations to determine reservoir fluid properties from field data taken in this case from McCain Jr., W. D., "Reservoir-fluid property correlations—state of the art," *SPE Reservoir Engineering* 6, 266-272 (1991).

(a) Estimate a value for the gas specific gravity ($\gamma_G^{CTOC}$) at $D^{CTOC}$ $\gamma_G^{CTOC}$.

(b) Calculate pseudo-critical pressure ($P_{pc}^{CTOC}$) at $D^{CTOC}$ by:

$$P_{pc}^{CTOC}=756.8-\gamma_G^{CTOC}(131+3.6\gamma_G^{CTOC})$$

(c) Calculate pseudo-critical temperature ($T_{pc}^{CTOC}$) at $D^{CTOC}$ by:

$$T_{pc}^{CTOC}=169.2-\gamma_G^{CTOC}(349.5+74.0\gamma_G^{CTOC})$$

(d) Calculate pseudo-reduced temperature ($T_{pr}^{CTOC}$) at $D^{CTOC}$ by:

$$T_{pr}^{CTOC} = \frac{(T^{CTOC}+459.69)}{T_{pc}^{CTOC}}$$

(e) Calculate pseudo-reduced pressure ($P_{pr}^{CTOC}$) at $D^{CTOC}$ by:

$$P_{pr}^{CTOC} = \frac{P_G^{CTOC}}{P_{pc}^{CTOC}}$$

(f) Calculate gas formation volume factor ($B_g$):

$$B_g = \frac{0.00502Z(T^{CTOC}+459.69)}{P_G^{CTOC}}$$

(g) Calculate gas in-situ density ($\rho_g$):

$$\rho_g = 0.21870617\left(\frac{(0.001)}{Bg}\right)\gamma_G^{CTOC}$$

(h) Compare predicted in-situ gas density to observed in-situ gas density.

(i) Use the difference between observed and predicted in-situ density to update the gas specific gravity guess ($\gamma_G^{CGOC}$) at $D^{CGOC}$ in the first sub-step of step 73.

(j) Repeat until the solution converges to obtain a gas gravity that matches observed pressure gradients to within an acceptable tolerance.

(2) Estimate Top Seal MICP.

(a) Calculate the brine-oil density contrast at the GOC ($\Delta\rho_{B\text{-}G}$)

$$\Delta\rho_{B\text{-}G}=(\rho_B-\rho_O)$$

(b) Use the brine-gas density differences to calculate the Firoozabadi Tau ($\tau$—see Firoozabadi & Ramey, "Surface tension of water-hydrocarbon systems at reservoir conditions," paper no. 87-38-30, presented at the 38$^{th}$ Annual Technical Meeting of the Petroleum Society of CIM, Calgary (Jun. 7-10, 1987)).

$$\tau=e^{[0.091251n(\Delta\rho_{B\text{-}G})^2-0.538331n(\Delta\rho_{B\text{-}G})+1.227328]}$$

(c) Use the Firoozabadi Tau ($\tau$) to calculate brine-gas interfacial tensions.

$$\eta_{B\text{-}G}^{CTOC}=[\Delta\rho_{B\text{-}G}(T_{pr}^{CTOC})^{-0.3125}\tau]^4$$

(d) Calculate an equivalent MICP for the current realization.

$$MICP = \frac{367.7GEP^{CTOC}}{\eta_{B-G}^{CTOC}}$$

Step 74: Estimate the Oil Entry Pressure (OEP) for Current Realization (1) Find a gas specific gravity at $D^{CGOC}$ to match observed gas leg pressures using a black oil model (correlations from McCain (1991) in this case).

(a) Guess a value for the gas specific gravity ($\gamma_G^{CGOC}$) at $D^{CGOC}$.

(b) Calculate pseudo-critical pressure ($P_{pc}^{CGOC}$) at $D^{CGOC}$ by:

$$P_{pc}^{CGOC}=756.8-\gamma_B^{CTOC}(131+3.6\gamma_B^{CTOC})$$

(c) Calculate pseudo-critical temperature ($T_{pc}^{CGOC}$) at $D^{CGOC}$ by:

$$T_{pc}^{CGOC}=169.2-\gamma_G^{CGOC}(349.5+74.0\gamma_G^{CGOC})$$

(d) Calculate pseudo-reduced temperature ($T_{pr}^{CGOC}$) at $D^{CGOC}$ by:

$$T_{pr}^{CGOC} = \frac{(T^{CGOC} + 459.69)}{T_{pc}^{CGOC}}$$

(e) Calculate pseudo-reduced pressure ($P_{pr}^{CGOC}$) at $D^{CGOC}$ by:

$$P_{pr}^{CGOC} = \frac{P_G^{CGOC}}{P_{pc}^{CGOC}}$$

(f) Calculate gas formation volume factor ($B_g$):

$$B_g = \frac{0.00502Z(T^{CGOC} + 459.69)}{P_G^{CGOC}}$$

(g) Calculate gas in-situ density ($\rho_g$):

$$\rho_g = 0.21870617\left(\frac{0.001}{B_g}\right)\gamma_G^{CGOC}$$

(h) Compare predicted in-situ gas density to observed in-situ gas density (i) Use the difference between observed and predicted in-situ density to update gas specific gravity guess ($\gamma_G^{CGOC}$) at $D^{CGOC}$ in the first sub-step of step 74.

(j) Repeat until the solution converges to obtain a gas gravity that matches observed pressure gradients to within an acceptable tolerance.

(2) Find an oil API gravity ($\gamma_{API}^{CGOC}$) to match the observed oil leg pressures using a black oil model (correlations from McCain (1991) assuming saturation in this case).

(a) Guess a value for the oil API gravity ($\gamma_{API}^{CGOC}$) at $D^{CGOC}$.

(b) Calculate the oil specific gravity ($\gamma_O^{CGOC}$) at $D^{CGOC}$.

$$\gamma_O^{CGOC} = \frac{141.5}{(\gamma_{API} + 131.5)}$$

(c) Assuming saturation, calculate the solution gas/oil ratio ($R_s$) at $D^{CGOC}$.

$$R_S^{CGOC} = \gamma_G^{CGOC}\left[\left(\frac{P_G^{CGOC}}{18.2^{+1.4}}\right)10^{(0.0125\rho_{API} - 0.0091T^{CGOC})}\right]^{(-0.83)}$$

(d) Calculate the saturated oil formation volume factor at the bubblepoint ($B_{ob}$).

$$B_{ob} = 0.9759 + 0.00012\left[R_S\left(\frac{\gamma_G^{CGOC}}{\gamma_O^{CGOC}}\right) + 1.25T^{CGOC}\right]^{1.2}$$

(e) Calculate oil in-situ density ($\rho_o$):

$$\rho_O = \frac{(\gamma_O^{CGOC} + 0.0002179 * R_S^{CGOC}\gamma_G^{CGOC})}{B_{ob}}$$

(f) Use difference between observed and predicted in-situ density to update oil API gravity guess ($\gamma_{API}^{GOC}$) at $D^{CGOC}$ in sub-step (a).

(g) Repeat until solution converges to obtain a $\gamma_{API}^{CGOC}$ that matches observed pressure gradients.

(3) Calculate the OEP from the GEP.

(a) Calculate the molecular weight of the dead oil ($M_O^{STP}$).

$$M_O^{STP} = 433.646 - 10.1264(\gamma_{API}^{CGOC} - 20.557)$$

(b) Calculate the critical temperature of the dead oil ($T_C^{STP}$).

$$T_C^{STP} = 23.8326281n(M_O^{STP})^2 + 166.4536841n(M_O^{STP}) - 300.639467$$

(c) Calculate the weight fraction of solution gas ($f_G^{GOC}$)

$$f_G^{CGOC} = \frac{\left(\frac{R_S^{CGOC}}{379.6}\right)}{\left(\left(\frac{R_S^{CGOC}}{379.6}\right) + 350.565\left(\frac{\gamma_O^{CGOC}}{M_O^{STP}}\right)\right)}$$

(d) Calculate the critical temperature of the live oil ($T_C^{CGOC}$) at $D^{CGOC}$.

$$T_C^{CGOC} = f_G^{CGOC}T_{pc}^{CGOC} + T_C^{STP}(1 - f_G^{CGOC})$$

(e) Calculate the pseudo-reduced temperature of the live oil ($T_{pr}^{CGOC}$) at $D^{CGOC}$.

$$T_{pr}^{CGOC} = \frac{(T^{CGOC} + 459.69)}{T_C^{CGOC}}$$

(f) Calculate the brine-oil density contrast at the GOC ($\Delta\rho_{O\text{-}B}^{CGOC}$).

$$\Delta\rho_{B\text{-}O} = (\rho_B - \rho_O)$$

(g) Use the brine-oil density differences to calculate the Firoozabadi Tau ($\tau$).

$$\tau = e^{[0.091251n(\Delta\rho_{B\text{-}O})^2 - 0.538331n(\Delta\rho_{B\text{-}O}) + 1.227328]}$$

(h) Use the Firoozabadi Tau ($\tau$) to calculate oil-brine interfacial tensions.

$$\eta_{B\text{-}O}^{CGOC} = [\Delta\rho_{B\text{-}O}(T_{pr}^{CGOC})^{-0.3125}\tau]^4$$

(i) Calculate the oil entry pressure.

$$OEP^{CGOC} = \frac{MICP(\eta_{B-O}^{CGOC})}{367.7}$$

Step 75: Obtain Statistical Distribution of Seal Capacity Estimates for Calibration Location Repeat steps 71-74 a predetermined number of times, averaging the results and calculating an uncertainty spread in MICP, $GEP^{CTOC}$, and $OEP^{CGOC}$.

Step 76: Combine Distributions of Seal Capacity Estimates from any Other Calibration Locations Repeat steps 71-75 for each calibration location summing the probability distributions for MICP, $GEP^{CTOC}$, and $OEP^{CGOC}$.

The person skilled in the art will recognize that the preceding embodiment also has value, compared to traditional approaches, as a stand alone method for estimating capillary seal capacity, either with the uncertainty estimate, or if desired, without. In the latter case in its most direct form, input parameter values would need to be selected in step 71, but for the prospect location. Then, steps 72-74 would be performed as described above.

Estimating Hydraulic Fracture Pressure (Step 62)

A detailed discussion follows of a preferred embodiment for estimating the mechanical seal capacity and associated uncertainty at a calibration location.

The basis for the deterministic mechanical seal capacity calculation resides with an evaluation of the effective stress of the reservoir at the top of the hydrocarbon column. As reservoir fluid pressures increase (i.e., hydraulic pressure at the top of the hydrocarbon column height increases), the effective stress decreases and there is an increased risk that the reservoir fluid pressure may open tensile fractures in the top seal (reservoir fluid pressures at this point equal or exceed the hydraulic fracture pressure, or $P_f$), thereby allowing hydrocarbons to escape. Two common occurrences increase the hydraulic pressure at the top of the hydrocarbon column: 1) an increase in hydrocarbon column height; and 2) an increase in reservoir aquifer pressure associated with an existing hydrocarbon column.

The techniques of the embodiment being described assist with the use of contact information to calculate mechanical seal capacity with respect to minimum compressive stress. This preferred embodiment is based on work by Mandl and Harkness, "Hydrocarbon migration by hydraulic fracturing" in *Deformation of Sediments and Sedimentary Rocks*, Geological Special Publication 29, 39-54, Jones and Preston, Ed's (1987) and Miller, T. W., "New insights on natural hydraulic fractures induced by abnormally high pore pressures," AAPG Bulletin 79, 1005-1018 (1995). These workers established a purely deterministic method to estimate the size of a hydrocarbon column necessary to hydrofracture the top seal of a trap, and to identify possible controls on single-phase hydrocarbon column heights.

Hydraulic fracture pressure is prescribed as a functional relationship between pressure and depth. This relationship may be manually specified by the user based on a priori knowledge. In other embodiments of the invention, this relationship may be calculated by at least two means: a linear "least-squares" regression to LOT (leak-off test) data or through determination of $\sigma_{h\ min}$ as described previously herein.

Input Quantities

For empirical hydraulic fracture pressure estimation, the following inputs are used in some embodiments of the invention:

- Leak-off test data from calibration location(s).
- Operational data, such as lost returns incidents, from calibration location(s).

For theoretical hydraulic fracture pressure estimation, the following inputs are used in some embodiments of the invention:

- Lithostatic pressure as a function of depth with uncertainty range ($P_{Lith}$).
- Pore pressure as a function of depth with uncertainty range ($P_{Pore}$).
- Ratio of minimum and maximum effective stress ($k_o$) with uncertainty range.

The empirical hydraulic fracture pressure estimation may be performed by following the following basic steps:

(1) Plot the empirical data as a function of depth.

(2) Calculate (a) simple best-fit linear regression line(s), minimizing the sum-of-squares of the vertical distances between the points and the line(s) by a technique such as that outlined in Davis, *Statistics and Data Analysis in Geology*, $2^{nd}$ Edition, John Wiley and Sons, Inc., USA, 176-204 (1986).

(3) Calculate standard confidence intervals, deriving a relationship between depth and fracture pressure with associated uncertainties by a technique such as that outlined in Davis (1986).

The theoretical hydraulic fracture pressure estimation may be performed by following the following basic steps:

(1) Plot $P_{Lith}$ and $P_{Pore}$ with associated uncertainty ranges as a function of depth.

(2) Calculate vertical effective stress ($\sigma_{eff}=P_{Lith}-P_{Pore}$) and associated uncertainty range.

(3) Calculate the minimum horizontal stress ($\sigma_{h\ min}$) and associated uncertainty range via:

$$\sigma_{h\ min}=k_o\sigma_{eff}+P_{pore}$$

where $$k_o=\frac{\sigma_3-P_{pore}}{\sigma_1-P_{pore}}$$

(for a uniaxial compressive state where compaction is in one direction with no lateral strains)=ratio of minimum and maximum effective stress; approximately 0.4 for strong materials to >0.8 for shale/clay.

(4) Repeat to determine minimum, most likely, and maximum values for $\sigma_{min}$ as a function of depth.

Probabilistic Calculation of Column Heights (Steps 64-67)

Steps 61 and 62 of a preferred embodiment have been described in detail, and with those descriptions, also step 63. These steps result in probability-weighted distributions for trap and fluid parameters at the prospect location, capillary entry pressure from calibration location(s), and hydraulic fracture pressure from calibration location(s). Next is the probabilistic procedure. A key to this analysis is recognition that the probability-weighted distributions of mechanical and capillary seal capacities must be adjusted to account for differences between the trap and fluid parameters at the calibration location and those selected in each realization of the prospect parameter distribution. In preferred embodiments of the invention, uncertainty distributions are assigned to all input parameters. The uncertainties are propagated throughout the analysis, enabling a statistical analysis of probabilistic simulation for risking and assessment.

Input quantities for the probabilistic calculation steps include the following.

Probability weighted distributions of prospect trap parameters (from step 63):

- Top of column ($D^{PTOC}$).
- Spill ($D^W$).
- Prospect temperature ($T^{PTOC}$) at $D^{PTOC}$.
- Prospect water depth ($D^W$).

Probability weighted distributions of prospect fluid parameters (from step 63):

- In-situ oil density ($\rho_O$)
- In-situ gas density ($\rho_G$)

In-situ brine density ($\rho_B$)

Formation pore excess pressure ($P_E$)

Probability weighted distributions of capillary entry pressure (from step 61):

MICP

Multiple fracture pressure vs. depth curves with associated confidence intervals (from step 62).

Following are steps in the preferred embodiment of the probabilistic calculation, with number references to the flow chart of FIG. 6.

Randomly Select a Value from Input Parameter Distributions (Step 64).

From selected inputs, calculate:

a) Brine pressure at $D^{PTOC}$.

$$P_B=\rho_{SW}gD^W+\rho_B gD^{PTOC}+P_E$$

Revise Oil Entry Pressure (OEP) and Gas Entry Pressure (GEP) Calculated from the Calibration Location(s) for Present Realization Prospect Conditions (Step 65).

(1) Calculate the prospect gas entry pressure from the MICP value determined from the calibration location(s), evaluating the gas properties at $D^{PTOC}$:

(a) Find a gas gravity ($\gamma_G$) that produces the selected in-situ density ($\rho_G$) as in step 73 of FIG. 7.

(b) Calculate the pseudo-critical gas temperature ($T_{pc}$) by:

$$T_{pc}=169.2+\gamma_G(349.5-74\gamma_G)$$

(c) Calculate pseudo-reduced gas temperature ($T_{pr}^{PTOC}$) by:

(d) Calculate the brine-gas density contrast ($\Delta\rho_{B\text{-}G}$):

$$\Delta\rho_{B\text{-}G}=(\rho_B-\rho_G)$$

(e) Use the brine-gas density difference to calculate the Firoozabadi Tau ($\tau$).

$$\tau=e^{[0.091251n(\Delta\rho_{B\text{-}G})^2-0.538331n(\Delta\rho_{B\text{-}G})+1.227328]}$$

(f) Use the Firoozabadi Tau ($\tau$) to calculate brine-gas interfacial tension.

$$\eta_{B\text{-}G}^{PTOC}=[\Delta\rho_{B\text{-}G}(T_{pr}^{PTOC})^{-0.3125}\tau]^4$$

(g) Use the brine-gas interfacial tension ($\eta_{B\text{-}G}^{PTOC}$) at the prospect $D^{PTOC}$ to calculate the GEP at the prospect $D^{PTOC}$:

$$GEP^{PTOC}=\frac{(\eta_{B-G}^{PTOC})MICP}{367.7}$$

(2) Calculate the prospect oil entry pressure from the MICP value determined from the calibration location(s), evaluating the oil properties at $D^{PTOC}$:

(a) Find an oil API gravity ($\gamma_{API}^{PTOC}$) and an oil specific gravity ($\gamma_O^{PTOC}$) to match selected in-situ density using a black oil model as in step 74 of FIG. 7.

(b) Assuming saturation, calculate the solution gas/oil ratio ($R_s^{PGOC}$) at $D^{PTOC}$:

$$R_s^{PTOC}=\gamma_G\left[\left(\frac{P_B^{PTOC}}{18.2+1.4}\right)10^{(0.0125\gamma_{API}^{PTOC}-0.0091T^{PTOC})}\right]^{(-0.83)}$$

(c) Calculate effective molecular weight ($M_{Weff}$).

$$M_{Weff}=433.646-10.1264(\gamma_{API}^{PTOC}-20.557)$$

(d) Calculate the critical temperature of the dead oil ($T_C^{STP}$)

$$T_C^{STP}=23.832628\log(M_{Weff})^2-0.53833\log(M_{Weff})+1.227328$$

(e) Calculate the weight fraction of solution gas ($f_G^{PGOC}$)

$$f_G^{PTOC}=\frac{\left(\frac{R_s^{PTOC}}{379.6}\right)}{\left(\left(\frac{R_s^{PTOC}}{379.6}\right)+350.565\left(\frac{\gamma_O^{PTOC}}{M_{Weff}}\right)\right)}$$

(f) Calculate the critical temperature of the live oil ($T_C^{PGOC}$) at $D^{PGOC}$.

$$T_C^{PTOC}=f_G^{PTOC}T_{pc}^{PTOC}+T_C^{STP}(1-f_G^{PTOC})$$

g) Calculate the pseudo-reduced temperature of the live oil ($T_{pr}^{PTOC}$) at $D^{PTOC}$.

$$T_{pr}^{PTOC}=\frac{(T^{PTOC}+459.6)}{T_C^{PTOC}}$$

h) Calculate the brine-oil density contrast ($\Delta\rho_{O\text{-}B}^{PTOC}$).

$$\Delta\rho_{B\text{-}O}^{PTOC}=(\rho_B-\rho_O^{PTOC})$$

i) Use the brine-oil density differences to calculate the Firoozabadi Tau ($\tau$).

$$\tau=e^{[0.091251n(\Delta\rho_{B\text{-}O}^{PTOC})^2-0.538331n(\Delta\rho_{B\text{-}O}^{PTOC})+1.227328]}$$

j) Use the Firoozabadi Tau ($\tau$) to calculate oil-brine interfacial tensions.

$$\eta_{B\text{-}O}^{PTOC}=[\Delta\rho_{B\text{-}O}^{PTOC}(T_{pr}^{PTOC})^{-0.3125}\tau]^4$$

k) Calculate the oil entry pressure.

$$OEP^{PTOC}=\frac{(\eta_{B-O}^{PTOC})MICP}{367.7}$$

Revise Hydraulic Fracture Pressure Based Upon Selected Trap Parameters in the Present Realization (Step 66).

Figure 8:
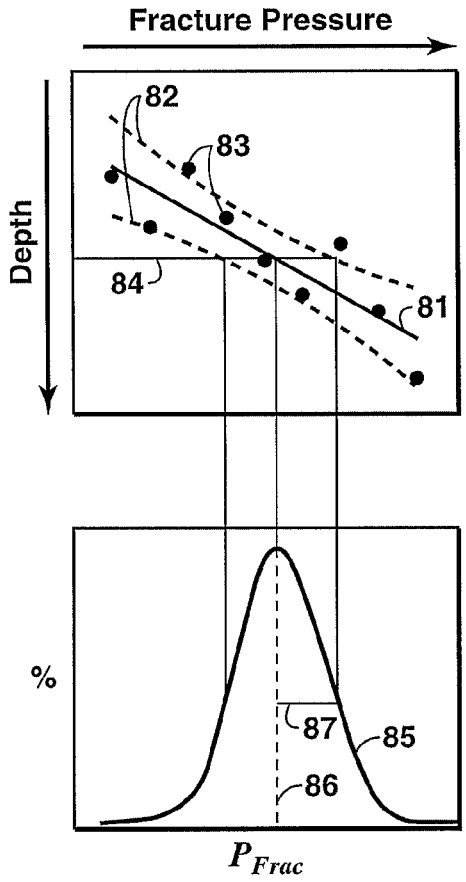
FIG. 8 illustrates developing a probability-weighted distribution for a parameter (fracture pressure) from empirical data.

1) For empirical hydraulic fracture pressure model (from step 62), calculate a probability-weighted distribution of hydraulic fracture pressure at $D^{PTOC}$:

(i) Referring to FIG. 8, equate best-fit (preferably in a least-squares sense) regression line 81 and 68.27% standard confidence intervals 82 determined at the estimated crest depth 84 of the subject trap, $D^{PTOC}$, to specify the mean 86 and one standard deviation 87 of a normal (Gaussian) distribution 85 of hydraulic fracture pressures. This determines the topology of the normal distribution curve from which the random trials will select hydraulic fracture pressures. The fracture pressure data points 83 plotted in FIG. 8 may be obtained, for example, from leak-off tests conducted at the calibration location(s). The estimate of the subject trap's crest depth may be obtained, for example, from seismic data.

(ii) Randomly select from the probability-weighted distribution from step (i) a hydraulic fracture pressure value ($P_f$) for the present realization.

Figure 9:
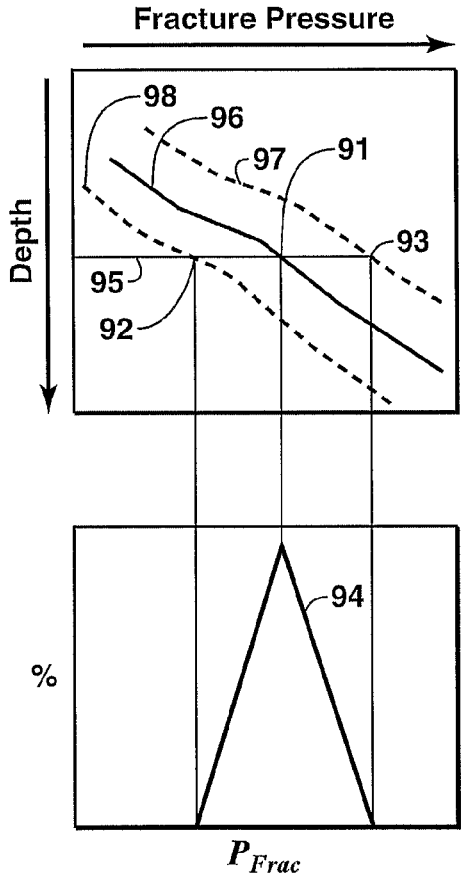
FIG. 9 illustrates developing a probability-weighted distribution for the parameter fracture pressure from a theoretical fracture pressure model.

2) For hydraulic theoretical fracture pressure model (from step 62), calculate a probability-weighted distribution of hydraulic fracture pressure at $D^{PTOC}$ (i) Referring to FIG. 9, equate most likely 91, minimum 92, and maximum 93 $\sigma_{h\ min}$ (i.e., $P_{Frac}$) determined at the estimated crest depth 95 for the subject trap, $D^{PTOC}$, to specify the most likely, minimum, and maximum values on a triangular distribution 94 of fracture pressures. The theoretical fracture pressure model is used to generate the curves 96, 97 and 98.

(ii) Randomly select from this probability-weighted distribution a hydraulic fracture pressure value ($P_f$) for the present realization.

Calculate Hydrocarbon Column Heights Consistent with Trap Parameters, Fluid Parameters, Hydraulic Fracture Pressure, OEP, and GEP in Present Realization (Step 67).

Alternative potential cases are depicted in FIGS. 5A-F. The procedure requires equating the calculated OEP and GEP to the buoyancy of the hydrocarbon column relative to the associated aquifer pressure gradient for capillary seal capacity, and equating the absolute pressure at the top of the hydrocarbon column (trap crest) to $P_f$ at the top of the column (trap crest) for mechanical seal capacity. The height of the hydrocarbon column (gas, oil, or combination of both) required to achieve the necessary buoyancy or absolute pressure is the seal capacity for that realization.

Repeat Steps 74-77 to Obtain More Realizations (Step 68). (Self Explanatory)

CONCLUSION

The foregoing application is directed to particular embodiments of the present invention for the purpose of illustrating it. It will be apparent, however, to one skilled in the art, that many modifications and variations to the embodiments described herein are possible. For example, a probability-weighted distribution which is random sampled in the present invention may be a single value assigned a probability of unity. Furthermore, it should be apparent to persons skilled in the art that detailed explanations presented hereinabove of how the steps of FIGS. 6 and 7 might be performed constitute but one or a few specific embodiments of the present inventive method, and are not intended to limit the broader description in the claims which is drafted to include all embodiments. To disclose all embodiments at this same level of detail would be both (a) impossible and (b) unnecessary for the understanding of the skilled practitioner. All such modifications and variations are intended to be within the scope of the present invention, as defined in the appended claims. The reader skilled in the art will also recognize that the invention will preferably be practiced with computer implementation, meaning that at least some parts of the method are performed on a computer.

Glossary of Abbreviations

| | |
|---|---|
| $B_g$ | Formation volume factor of dry gas, res $ft^3$/scf or RB/scf |
| $B_{ob}$ | Saturation oil formation volume factor, RB/STB |
| D | Depth (ft) |
| f | Weight fraction |
| g | Gravitational constant |
| GEP | Gas entry pressure (psi) |
| IFT | Interfacial tension (dynes/$cm^2$) |
| $k_o$ | lithology dependent horizontal to vertical stress ratio |
| MICP | Mercury-injection capillary pressure |
| OEP | Oil entry pressure (psi) |
| P | Pressure (psi) |
| $R_s$ | Solution gas-oil ratio |
| T | Temperature (° F.) |
| Z | Z factor |

-continued

Glossary of Abbreviations

| Symbols | |
|---|---|
| $\gamma$ | Specific gravity (w/respect to air for gas or water for oil) e |
| $\eta$ | Interfacial tension |
| $\rho$ | Density (g/$cm^3$) |
| $\sigma$ | Stress (psi) |
| $\sigma_{eff}$ | Effective stress (psi) |
| $\sigma_{hmin}$ | Horizontal minimum stress (psi) |
| $\sigma_1$ | Maximum compressive stress |
| $\sigma_3$ | Minimum compressive stress |
| $\tau$ | Firoozabadi tau |
| **Superscripts** | |
| TOC | Top of column |
| OWC | Oil-water contact |
| GOC | Gas-oil contact |
| C | Calibration location |
| P | Prospect location |
| STP | Standard temperature and pressure (60° F., 14.65 psia) |
| **Subscripts** | |
| API | American Petroleum Institute |
| B | Brine |
| O | Oil |
| G or g | Gas |
| lith | Lithostatic |
| pore | Pore |
| pc | Pseudo-critical |
| pr | Pseudo-reduced |
| F or f | Fracture |
| Hg | Mercury |
| a | Air |

The invention claimed is:

1. A method for evaluating seal capacity in order to determine hydrocarbon column heights, and optionally associated probable errors, for a subject hydrocarbon trap containing oil, gas, or both oil and gas, said method comprising:

(a) estimating a probability-weighted distribution for capillary entry pressure values at one or more calibration locations by equating capillary entry pressure with hydrocarbon buoyancy estimated through inversion of trap and fluid property data;

(b) estimating a probability-weighted distribution for hydraulic fracture pressure values from calculations using theoretical calculation or from empirical data collected from one or more calibration locations;

(c) obtaining probability-weighted distributions for anticipated fluid properties and trap geometry parameters at the subject hydrocarbon trap, said properties and parameters including:

(1) in-situ fluid density, wherein the in-situ fluid comprises one or more of gas, oil, and brine;

(2) reservoir pressure;

(3) reservoir temperature;

(4) trap geometry, including crest and spill depths;

(d) for a current realization, determining a current realization value for each of the fluid properties and trap geometry parameters of the subject trap by randomly selecting from their respective probability-weighted distributions;

(e) using a computer, determining a current realization value for the subject trap's capillary entry pressure by:

randomly selecting a capillary entry pressure value from the probability-weighted distribution determined for the one or more calibration locations; and adjusting the selected capillary entry pressure value by calculating interfacial tensions consistent with the subject hydrocarbon trap's pressure, temperature, and fluid composition selected for the current realization;

(f) using a computer, determining a current realization value for the subject trap's hydraulic fracture pressure by:

randomly selecting a hydraulic fracture pressure value from the probability-weighted distribution determined by calculation or empirical data from one or more calibration locations; and adjusting the selected hydraulic fracture pressure value consistent with the trap crest depth selected for the current realization, thereby generating an adjusted hydraulic fracture pressure gradient;

(g) using a computer, calculating a column height for each hydrocarbon phase present in the subject trap using the randomly selected fluid properties and trap geometry parameters of the subject trap for the current realization, said calculation equating hydrocarbon buoyancy with total seal capacity, said total seal capacity being obtained by combining the adjusted hydraulic fracture pressure gradient and capillary entry pressure values determined for the current realization, and said each hydrocarbon phase comprises one of oil and gas;

(h) repeating steps (d)-(g) a predetermined number of times; and (i) using a computer, averaging results from step (h) and optionally calculating an uncertainty for each column height from spread within the results.

2. The method of claim 1, wherein estimating a probability-weighted distribution for capillary entry pressure values at a calibration location comprises:

(a) obtaining probability-weighted distributions for fluid properties and trap geometry parameters at the calibration location;

(b) randomly selecting a current realization value for each said fluid property and trap geometry parameter from their probability-weighted distributions;

(c) estimating gas entry pressure (GEP) from hydrocarbon column buoyancy using the current realization values of the fluid properties and trap geometry parameters;

(d) optionally estimating implied mercury injection capillary pressure (MICP) using the current realization values of the fluid properties and trap geometry parameters and by calculating brine-gas interfacial tensions;

(e) calculating oil entry pressure (OEP) from the gas entry pressure; and (f) repeating steps (b)-(e) a pre-selected number of times, averaging results from repeating steps (b)-(e) and estimating a probability-weighted distribution for GEP, OEP and, optionally, MICP.

3. The method of claim 1, wherein the empirical data for estimating a probability-weighted distribution for hydraulic fracture pressure values is leak-off test data.

4. The method of claim 1, wherein the theoretical calculation for estimating a probability-weighted distribution for hydraulic fracture pressure values uses critical-state soil mechanics to solve a minimum stress equation in which hydraulic fracture pressure is approximated by minimum horizontal stress.

5. The method of claim 4, wherein the minimum horizontal stress $\sigma_{h\ min}$ is calculated from $$\sigma_{h\ min}=k_o\sigma_{eff}+P_{pore}$$

where $$k_o=\frac{\sigma_3-P_{pore}}{\sigma_1-P_{pore}}$$

and $\sigma_{eff}=P_{Lith}-P_{Pore}$, and $P_{Pore}$ is pore pressure, $P_{Lith}$ is lithostatic pressure, $\sigma_3$ is minimum compressive stress and $\sigma_1$ is maximum compressive stress.

6. The method of claim 1, wherein the probability-weighted distribution for randomly selecting a hydraulic fracture pressure value is obtained from empirical fracture pressure data by:

(a) determining a best-fit straight line in a least-squares sense for a plot of the empirical fracture pressure data versus depth;

(b) determining 68.3% confidence interval curves for the said best-fit line; and (c) using values of the best-fit line and the confidence interval curves at the subject trap's crest depth to determine a Gaussian probability distribution of fracture pressure values.

7. The method of claim 1, wherein the probability-weighted distribution for randomly selecting a hydraulic fracture pressure value is calculated by:

(a) selecting a theoretical model of fracture pressure versus depth;

(b) using said model to determine most likely, minimum and maximum values of fracture pressure at the crest depth of the subject trap;

(c) creating a triangular probability distribution of fracture pressure values from said most likely, minimum and maximum fracture pressure values.

8. The method of claim 1, wherein hydrocarbon buoyancy is estimated in a groundwater aquifer by:

(a) obtaining hydrocarbon depth and fluid density data from said one or more calibration locations;

(b) developing a black oil empirical model of hydrocarbon fluid properties;

(c) selecting an aquifer composition model and gas equation of state that may be used to correct aquifer and gas densities for variations in pressure and temperature;

(d) adjusting input parameters of the black oil model and the aquifer composition model to match measured in situ well bore fluid densities;

(e) adjusting fluid gradients as a function of pressure and temperature within the trap using the said models to extrapolate away from the one or more calibration locations to the trap, yielding hydrocarbon and aquifer depth versus pressure curves at the trap's structural crest; and (f) deducing hydrocarbon buoyancy pressure from differences between the aquifer depth-pressure curve and the hydrocarbon depth-pressure curve.

9. The method of claim 1, wherein said capillary entry pressure comprises a gas entry pressure and an oil entry pressure, and wherein gas entry pressure is estimated from hydrocarbon column buoyancy, and further wherein at least one of oil entry pressure and mercury injection capillary pressure are calculated from the gas entry pressure and interfacial tension (η) using the relationship $$\frac{MICP}{\eta_{Hg\text{-}air}\cos\theta_{Hg\text{-}air}}=\frac{OEP}{\eta_{B-O}\cos\theta_{B-O}}=\frac{GEP}{\eta_{B-G}\cos\theta_{B-G}}$$

where $\theta_{ij}$ is contact angle for interfacing fluids i and j, and where interfacial tension ($\eta_{ij}$) at an interface between substance i and substance j is calculated from $$\eta_{ij}=[\Delta\rho_{ij}(T_{pr})^{-0.3125}\tau]^4$$

where $\tau=e^{[0.091251n(\Delta\rho)^2-0.538331n(\Delta\rho)+1.227328]}$, $T_{pr}$ is pseudo-reduced temperature calculated from the black-oil correlations, and $\Delta\rho$ is the density difference between substance i and substance j, and where i,j refer to gas-water (B-G), oil-water (B-O) or mercury-air (Hg-air) interfaces.

10. The method of claim 9, wherein gas entry pressure GEP is estimated from hydrocarbon column buoyancy using the relationship:

$$GEP=\rho_B g(D^{OWC}-D^{TOC})-[\rho_O g(D^{OWC}-D^{GOC})+\rho_G g(D^{GOC}-D^{TOC})]$$

where $\rho$ is density for fluids brine (subscript B for brine (water)), oil (subscript O) and gas (subscript G); g is acceleration due to gravity; and D is depth to oil-water contact (superscript OWC), gas-oil contact (superscript GOC) and top of the hydrocarbon column (superscript TOC).

11. The method of claim 9, wherein said capillary entry pressure further comprises one of a gas entry pressure for a single-hydrocarbon-phase trap and an oil entry pressure for a single-hydrocarbon-phase trap.

12. The method of claim 9, wherein said capillary entry pressure further comprises a mercury injection capillary pressure.

13. A method for producing hydrocarbons from a subterranean formation, comprising:

(a) obtaining identification of one or more hydrocarbon traps in the formation;

(b) obtaining evaluation of seal capacity and hydrocarbon column heights for said one or more hydrocarbon traps, said evaluation having used the method of claim 1;

(c) using a computer, obtaining an assessment of the hydrocarbon traps for commercial potential based on the evaluation of the previous step; and (d) producing hydrocarbons from a trap showing commercial potential.

* * * * *